United States Patent [19]

Suyama et al.

[11] 4,276,452

[45] Jun. 30, 1981

[54] MEMBRANE TYPE ELECTRO-ACOUSTIC TRANSDUCER

[75] Inventors: Hideo Suyama, Yokohama; Masana Ugaji, Tokyo, both of Japan

[73] Assignee: Sony Corporation, Tokyo, Japan

[21] Appl. No.: 63,032

[22] Filed: Aug. 2, 1979

[30] Foreign Application Priority Data

Aug. 15, 1978 [JP] Japan ..... 53-99293

[51] Int. Cl.[3] ..... H04R 7/26

[52] U.S. Cl. ..... 179/180; 179/115.5 PV; 181/166

[58] Field of Search ..... 179/115.5 PV, 115 V, 179/180, 181 R, 115 R; 181/166

[56] References Cited

U.S. PATENT DOCUMENTS 3,873,784 3/1975 Doschek ..... 179/115.5 PV
3,997,739 12/1976 Kishikawa et al. ..... 179/115.5 PV
4,037,061 7/1977 von Recklinghausen ..... 179/115.5 PV

FOREIGN PATENT DOCUMENTS 574642 7/1925 France ..... 179/180

OTHER PUBLICATIONS

"Magneplanar Tympani," Audio Research Corporation Advertisement, *Audio*, Aug. 1974, p. 64.

*Primary Examiner*—Thomas W. Brown
*Attorney, Agent, or Firm*—Hill, Van Santen, Steadman, Chiara & Simpson

[57] ABSTRACT

In an electro-acoustic transducer having a magnetic circuit and a vibrative member disposed in an air gap formed in the magnetic circuit, the vibrative member having a frame with an opening, a membrane mounted on the frame, an acoustic transparent member mounted on the frame so as to define a space between the membrane and the acoustic transparent member, and an acoustic damping material disposed in the space.

7 Claims, 6 Drawing Figures

MEMBRANE TYPE ELECTRO-ACOUSTIC TRANSDUCER

BACKGROUND OF THE INVENTION

1. Field of the Invention

This invention relates generally to an electro-acoustic transducer, and more particularly to a loudspeaker having an improved vibrative member.

2. Description of the Prior Art

In recent year, various types of transducers utilizing a drive system have been developed for the purpose of reproducing high fidelity sounds.

As an example of the prior art transducers, there is proposed a so-called a ribbon type transducer. This type transducer is constructed with a magnetic circuit having at least one air gap, and a diaphragm having a conductor thereon and disposed in the air gap. In this case, when an electrical signal is applied to the conductor formed on the diaphragm, a sound is generated by the vibration of the diaphragm since the signal current flows through the conductor in the direction perpendicular to the magnetic field on the air gap.

In general, the diaphragm of an ordinary transducer has inherent vibration. When a signal having frequencies coincident with the inherent frequency of the diaphragm is applied thereto, the transducer or speaker emits an abnormal sound. In the art, in order to avoid the generation of such abnormal sounds, a damping material such as a glass-wool is brought into contact with the inner surface of the diaphragm to suppress its inherent vibrations. However, the above prior art damping material has a problem because it is impossible to bring the diaphragm into contact with the damping material uniformly and hence the desired effects can not be obtained. Further, when the speaker is assembled, it requires a number of steps to arrange the damping material and also the characteristics of speakers vary after the speakers are assembled.

It is also known to have a metallic mesh mounted on the inner surface of the vibrative member with a spacer and then glass-wool is placed between the metallic mesh and the diaphragm. This method, however, can not solve the above problem.

OBJECTS AND SUMMARY OF THE INVENTION

Accordingly, an object of the present invention is to provide a novel electro-acoustic transducer.

Another object of the invention is to provide an electro-acoustic transducer in which the inherent vibration of a diaphragm thereof is suppressed.

A further object of the invention is to provide an electro-acoustic transducer in which a damping material contacts all of the surface of a membrane uniformly to generate high fidelity sound.

A further object of the invention is to provide an electro-acoustic transducer which can be easily constructed and has uniform reproduction characteristics.

A still further object of the invention is to provide an electro-acoustic transducer which is provided with a magnetic circuit to produce a magnetic flux which extends obliquely to a conductor.

According to an aspect of the present invention, an electro-acoustic transducer is provided which comprises a magnetic circuit structure having at least one air gap, and a vibrative structure disposed in the air gap, the vibrative structure comprising a frame member having at least one opening, a membrane fixed on the frame member so as to cover the opening, an acoustic-transparent member fixed on the frame member so as to form a space between the membrane and acoustic-transparent member, and an acoustic damping material disposed in the space in such a manner that the acoustic damping material smoothly contacts the membrane.

The other objects, features and advantages of the present invention will be apparent from the following description taken in conjunction with the accompanying drawings in which the like reference numerals designate the same elements and parts.

DESCRIPTION OF THE PREFERRED EMBODIMENTS

This invention will be hereinafter described with reference to the attached drawings.

Figure 1:
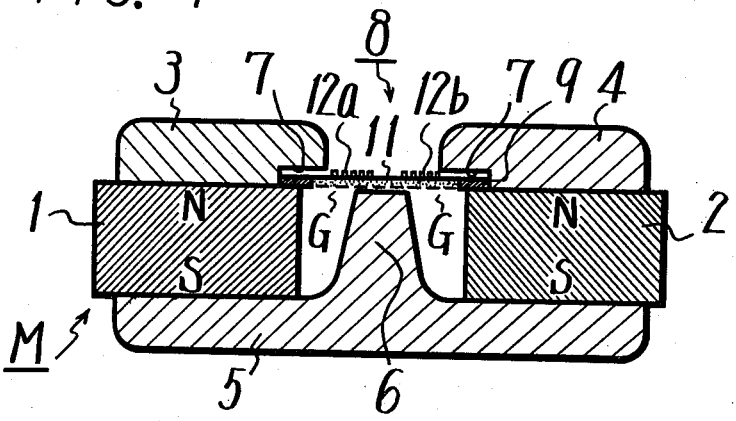
FIG. 1 is a cross-sectional view showing an example of the electro-acoustic transducer according to the present invention.

Turning to FIG. 1 which is a cross-sectional view showing an example of the electro-acoustic transducer according to the invention, there are provided first and second magnets 1 and 2, which are each of rectangular shape and disposed symmetrical with respect to the longitudinal center line therebetween. First and second magnetic pole plates 3 and 4, each being of a rectangular shape, are disposed on the surfaces of N-poles of first and second magnets 1 and 2, respectively. A yoke 5 is disposed in contact with the surfaces of S-poles of first and second magnets 1 and 2. The yoke 5 has a center pole 6 which is integral with the yoke 5, elongated along the longitudinal direction of the magnets and has a predetermined height. As is clear from FIG. 1, the first and second magnets 1 and 2 are located at both sides of the center pole 6 and spaced a certain distance therefrom, and the first and second magnetic pole plates 3 and 4 on the N-pole sides of magnets 1 and 2 extend toward each other. In other words, between the first pole plate 3 and center pole 6 and between the center pole 6 and second pole plate 4, there are provided air gaps G in which magnetic fields exist. In this case, a magnetic circuit M is formed by the pole plates 3, 4, yoke 5, center pole 6 and magnets 1, 2 including the gaps G.

On the inner surfaces of inwardly extending portions of the first and second magnetic pole plates 3 and 4, i.e. these portions corresponding to the inner and upper corners of the first and second magnets 1 and 2, there are formed symmetrical L-shaped recesses 7 adjacent the center pole 6, respectively. A vibrative structure 8 (which includes a membrane, a conductor and a fixture plate described later) is disposed in the recesses 7.

Figure 2:
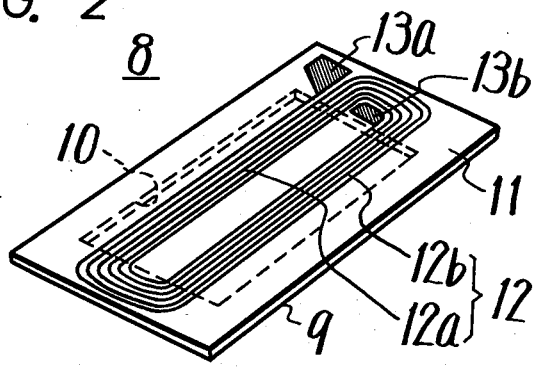
FIG. 2 is a perspective view showing, in an enlarged scale, the vibrative member used in the example of FIG. 1.

As shown in FIG. 2, the vibrative structure 8 consists of a rectangular fixture plate 9 made of, for example, resin with a rectangular aperture 10, a membrane (vibratory diaphragm) 11, which is made of a resin film such as a mylar film polyamide film or the like and fixed to one surface of the fixture plate 9 to cross the aperture 10, and a conductor 12, which is provided in such a manner that a metal layer such as aluminum film is coated on the surface of membrane 11 by, for example, vaporization and this metal layer is subjected to photoetching to form an oval spiral pattern. In FIG. 2, 12*a* and 12*b* designate the positive and negative paths of the oval spiral pattern conductor 12, and 13*a* and 13*b* designate terminals to connect lead wires to both ends of conductor 12.

The vibrative structure 8 constructed as above is stretched between the first and second magnetic pole plates 3 and 4 and above the center pole 6 so that both the paths 12*a* and 12*b* of oval spiral pattern conductor 12 on the membrane 11 will be located in the magnetic field described in connection with FIG. 1. If an aural electric signal is fed to the conductor 12, the membrane 11 is driven or vibrated and the electric signal is converted into a sound or acoustic signal. While, if a sound sgnal is applied to the membrane 11, the corresponding electric signal can be derived from the terminals of the conductor 12. In the illustrated example of the invention shown in FIGS. 1 and 2, the magnetic pole plates 3 and 4 are positioned above the top surface of center pole 6, so that the magnetic flux passes obliquely from the pole plates 3 and 4 to the center pole 6. Thus, since the magnetic flux effectively crosses the conductor 12, it is appreciated that the electro-acoustic conversion efficiency is greatly improved over arrangements heretofore known.

Figure 3:
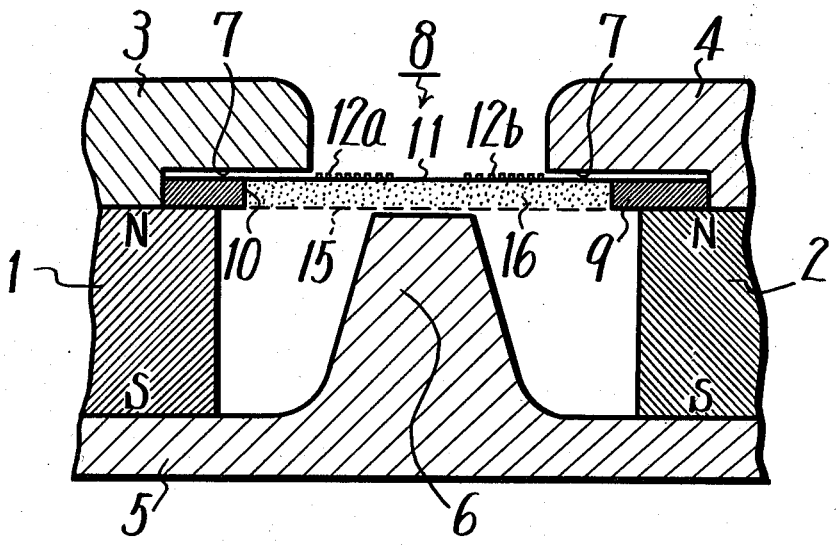
FIG. 3 is a cross-sectional view showing, in an enlarged scale, a part of FIG. 1.

In the above electro-acoustic transducer (which will be referred to as a speaker), it is necessary to avoid the generation of abnormal sounds by suppressing the inherent vibration mode of membrane 11. To this end, as shown in FIG. 3 which is an enlarged view of a part of FIG. 1, the membrane 11 is stretched on one surface (outer surface) of fixture plate 9 of vibrative structure 8, and an acoustic-transparent member 15, which is, for example, a silk-mesh, mesh-texture or similar material which is strong, is stretched on the other surface (inner surface) of fixture plate 9. Within the rectangular aperture 10 which is closed by the acoustic-transparent member 15 and membrane 11, there is previously placed an acoustic damping material 16 which is substantially coincident with the rectangular aperture 10 in configuration and dimension and which has a predetermined thickness so that it will be gripped by the membrane 11 and the acoustic-transparent member 15. In this case, the acoustic damping material 16 is to be in uniform contact with the membrane 11, and the acoustic transparent member 15 and membrane 11 are fixed to the fixture plate 9 by an adhesive agent.

The acoustic damping material 16 may be a material which is soft, low in density and strong, for example, material made by overlapping thin fibers or urethane fibers.

The inventors of this invention have sufficiently ascertained by experiments that the membrane with the above structure greatly improves the damping characteristics, as will be described later.

Figure 4:
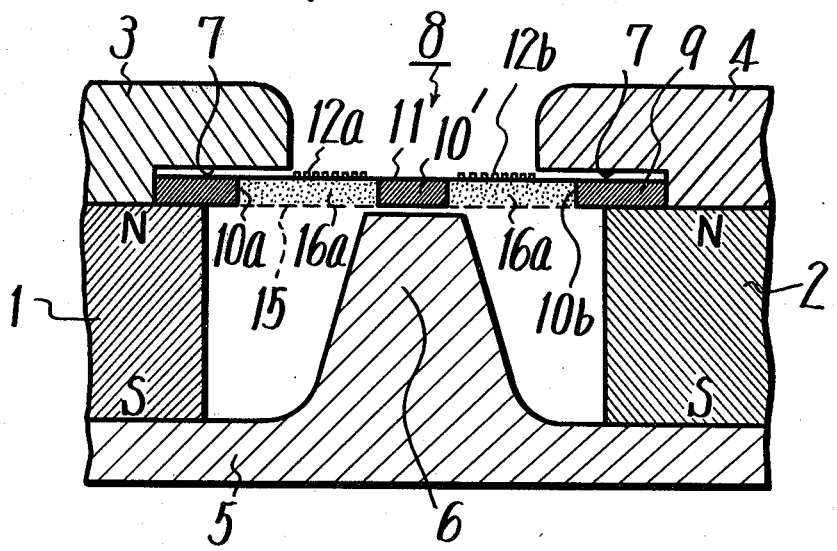
FIG. 4 is a cross-sectional view showing, in an enlarged scale, a part of another example of the electro-mechanical transducer according to the present invention.

FIG. 4 is an enlarged cross-sectional view similar to FIG. 3 showing an essential part of another example of the electro-acoustic transducer according to the invention. In FIG. 4, the reference numerals which are the same as those of FIGS. 1 to 3 designate the same elements and parts.

In the example of the invention shown in FIG. 4, a crosspiece 10′ is provided along the longitudinal center line of the rectangular aperture 10 in the fixture plate 9 to define symmetrical apertures 10*a* and 10*b* with respect to the cross piece 10′, and separate acoustic damping materials 16*a* and 16*b* are placed in the apertures 10*a* and 10*b*, respectively, which materials 16*a* and 16*b* are gripped by the membrane 11 and the acoustic-transparent member 15 similar to the former example. In this case, the damping action of the materials 16*a* and 16*b* for the membrane 11 is substantially the same as that of the former example.

Figure 5:
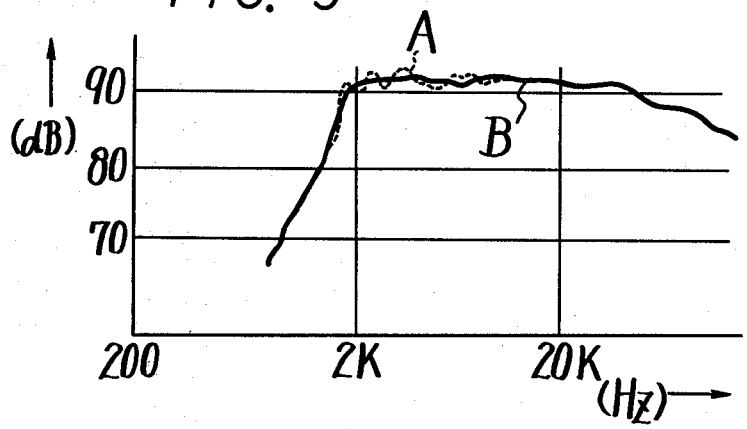
FIG. 5 is a graph showing the sound pressure to frequency characteristics of the transducers of the present invention and prior art.

FIG. 5 is a graph showing the sound pressure versus frequency characteristics of a speaker of the prior art and those of the speaker according to the present invention. In the graph of FIG. 5, a dotted-line curve A corresponds to the prior art speaker and a solid line curve B corresponds to the speaker of the invention, respectively. As will be clearly understood from this graph, since in the prior art speaker the damping is not achieved uniformly, peaks and dips appear in a low frequency range between 2 $KH_z$ and 5 $KH_z$ as shown by the dotted-line curve A, while in the speaker of the invention the uniform frequency characteristics have no peaks and dips as shown by the solid line curve B.

Figure 6:
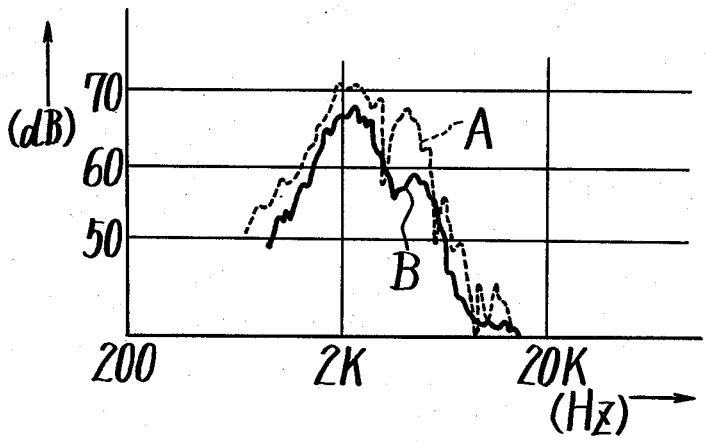
FIG. 6 is a graph showing the high frequency distortion to frequency characteristics of the transducers of the invention and prior art.

FIG. 6 is a graph showing the frequency versus distortion characteristics of speakers of the prior art and those of the speaker according to this invention, in which a dotted-line curve A corresponds to the prior art speaker and a solid line curve B corresponds to that of the invention, respectively. As may be apparent from the curve A, in the prior art speaker the secondary high harmonic distortion factor is high in the frequency range between 2 $KH_z$ and 5 $KH_z$, and accordingly it will be realized that the tertiary high harmonic distortion is high. In the speaker of this invention high harmonic distortions are suppressed as shown by the curve B.

As described above, according to the speaker or electro-acoustic transducer of this invention, its membrane can be effectively and uniformly damped all over the surface thereof, and also the acoustic damping material is assembled together with the acoustic-transparent member and the membrane as the vibrative structure, so that the speaker of this invention is suitable for mass production and its characteristics are improved.

It will be apparent that many modifications and variations could be effected by one skilled in the art without departing from the spirits or scope of the novel concepts of the present invention so that the spirits or scope of the invention should be determined by the appended claims.

We claim as our invention:

1. An electro-acoustic transducer comprising:

(a) a magnetic circuit structure having at least one air gap; and (b) a vibrative structure disposed in said air gap; said vibrative structure comprising a frame member having at least one opening, a membrane fixed on said frame member so as to cover said opening, an acoustic-transparent member fixed on said frame member so as to form a space between said membrane and acoustic-transparent member, and an acoustic damping material disposed in said space in such a manner that said acoustic damping material smoothly contacts said membrane.

2. An electro-acoustic transducer as claimed in claim 1, wherein said acoustic-transparent member is a silk-mesh.

3. An electro-acoustic transducer as claimed in claim 1, wherein said frame member has front and back surfaces, said membrane is fixed to said front surface, said acoustic-transparent member is fixed to said back surface, and said acoustic damping material is disposed in a space between said front and back surfaces of said frame member.

4. An electro-acoustic transducer as claimed in claim 3, wherein said acoustic-transparent member is a silk-mesh and said acoustic damping material is made of urethane.

5. An electro-acoustic transducer as claimed in claim 3, wherein said membrane is a high molecular film.

6. An electro-acoustic transducer comprising:

(a) a magnetic circuit including a pair of permanent magnets parallely positioned with each other;

(b) a yoke magnetically coupled to said permanent magnets and having a center pole;

(c) and a pair of pole plates magnetically coupled to said magnets, said center pole being positioned between said pole plates;

(d) a pair of air gaps formed by said center pole and each of said pole plates, and (e) a vibrative structure disposed in said air gaps, said vibrative structure comprising a frame member positioned under said pole plates and having at least one opening, a membrane fixed on said frame so as to cover said opening, an acoustic-transparent member fixed on said frame so as to form a space between said membrane and acoustic-transparent member, and an acoustic damping material disposed in said space in such a manner that the acoustic damping material smoothly contacts said membrane.

7. An electro-acoustic transducer as claimed in claim 6, wherein said membrane has a conductor and said pole plates are positioned above said center pole, whereby a magnetic flux generated between said center pole and said pole plates crosses said conductor obliquely.

* * * * *